US005298907A

United States Patent [19]

Klein

[11] Patent Number: 5,298,907

[45] Date of Patent: Mar. 29, 1994

[54] BALANCED POLARIZATION DIVERSIFIED CELLULAR ANTENNA

[75] Inventor: Joseph Klein, Northridge, Calif.

[73] Assignee: Alliance Research Corporation, Chatsworth, Calif.

[21] Appl. No.: 905,796

[22] Filed: Jun. 29, 1992

[51] Int. Cl.[5] ..... H01Q 1/32; H01Q 1/50; H01Q 21/24

[52] U.S. Cl. ..... 343/715; 343/830; 343/859

[58] Field of Search ..... 343/713, 715, 850, 859, 343/846, 829, 830; H01Q 1/32, 21/24, 1/50

[56] References Cited

U.S. PATENT DOCUMENTS

| | | | |
|---|---|---|---|
| 4,764,773 | 8/1988 | Larsen et al. | 343/715 |
| 4,794,319 | 12/1988 | Shimazaki | 343/715 |
| 4,839,660 | 6/1989 | Hadzoglou | 343/715 |
| 4,875,051 | 10/1989 | Blaese | 343/715 |
| 4,929,961 | 5/1990 | Nakase | 343/715 |
| 4,992,800 | 2/1991 | Parfitt | 343/715 |
| 4,999,642 | 3/1991 | Wells | 343/715 |

*Primary Examiner*—Michael C. Wimer
*Attorney, Agent, or Firm*—Matthew F. Jodziewicz

[57] ABSTRACT

A vehicle antenna for a cellular telephone has a balanced-unbalanced (BALUN) transformer that is connected to the telephone and is coupled to a horizontally polarized antenna on the interior of the vehicle and to a vertically polarized antenna that is located on the exterior of the vehicle. The vertically polarized component of a received signal is combined with the horizontally polarized component of the same signal in the transformer element and is applied to the cellular telephone. Signals to be transmitted are applied to the the transformer element and are divided into two portions, one of which is applied to the vertically polarized antenna and the other of which is applied to the horizontally polarized antenna. Because signals from a remote cellular transmitter cell arrive with both a vertical and a horizontal component, the antenna of the present invention retrieves the horizontal component which would otherwise be lost and combines it with the vertical component for more reliable signal reception.

2 Claims, 2 Drawing Sheets

BALANCED POLARIZATION DIVERSIFIED CELLULAR ANTENNA

The present invention relates to antennas and, more particularly, an antenna for cellular telephones.

The adoption and use of cellular telephones for communication in vehicles has resulted in a need for a suitable antenna to transmit and receive signals in the 800–940 MHz frequency bands. To accommodate a vehicle installation of the telephone transceiver, antennas have been designed to mount to nonconductive surfaces of a vehicle, such as windows, windshields and the like.

These antennas provide an exterior element that includes a radiating mast and an interior element that includes a termination for a coaxial cable that connects to the transceiver. The two elements can electrically connect without the need for an aperture through a capacitive coupling using the nonconductive material as dielectric.

Several such "through glass" antennas have been disclosed in patents including the patents cited in Col. 1 of the patent to Shimizaki, U.S. Pat. No. 4,794,319, assigned to the assignee of the present invention.

These antennas of the prior art, whether "current fed", "voltage fed", or fed by a current/voltage combination are similar in that they all radiate and receive signals that are vertically aligned. That is, the antenna mast is directed in a substantially vertical orientation, even though some installations, whether intentionally or by accident, permit some orientation that is not purely vertical.

It has been discovered that in metropolitan, urban areas where the roadways are surrounded by large, multi-story structures, signals which were initially transmitted with a vertical polarization orientation, as a result of multiple reflections and scattering from a plurality of surfaces, tend to have a horizontal component which cannot be efficiently captured by a conventional, near vertical antenna mast. It has also been found that the problem of fading signals received by a vertical mast can be reduced if the horizontal component could be captured in some way.

While this may not be a serious problem for the vehicle antenna receiving signals from a strong, powerful transmitter, the signal can be degraded and may be marginal. However, this can create a problem for the transmitter in the vehicle, which is power limited. These weaker signals may not be reliably received and retransmitted by the equipment in the cell.

SUMMARY OF INVENTION

It has therefore been deemed desirable to have a vehicular cellular antenna that is capable of transmitting and receiving signals that are both vertically and horizontally oriented. According to the present invention, the signal from the transceiver is applied to a BALUN which passes most of the signal to the vertical radiator, but applies the remainder of the signal to a horizontally oriented radiator.

Incoming vertically polarized signals are received by the vertical mast and signals, which as a result of reflection and scattering have a horizontal orientation, can be received by the horizontally oriented antenna elements. These signals are then combined in the BALUN and are then applied to the receiver circuits. Since the path traveled by the scattered and direct signals is substantially the same and the received direct and scattered signals are cross polarized, the effects of any phase difference between the two components, at the frequencies of interest, may be safely ignored.

An integral element of the present invention is a box radiator to which some of the energy is applied in a balanced to unbalanced (BALUN) coupling. In the present invention, the vertical radiator is excited. The box which contains the matching circuit is "excited", and the unbalanced coaxial feed cable views a "matched" circuit and therefore has a low voltage standing wave ratio (VSWR).

Accordingly, it is an object of the present invention to provide a cellular telephone antenna capable of transmitting and receiving both horizontally and vertically polarized signals. It is an additional object of the invention to provide an antenna for cellular phones that can recover the horizontally polarized component of a signal that was transmitted in a vertical polarization, but which, through reflections, has acquired a non vertically polarized component.

It is a further object of the invention to provide a cellular telephone antenna that can transmit both a vertically and horizontally polarized signal which, as a result of random reflections in the signal path, will provide a signal with a relatively stronger vertically polarized component at the cell receiver.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF INVENTION

Figure 1:
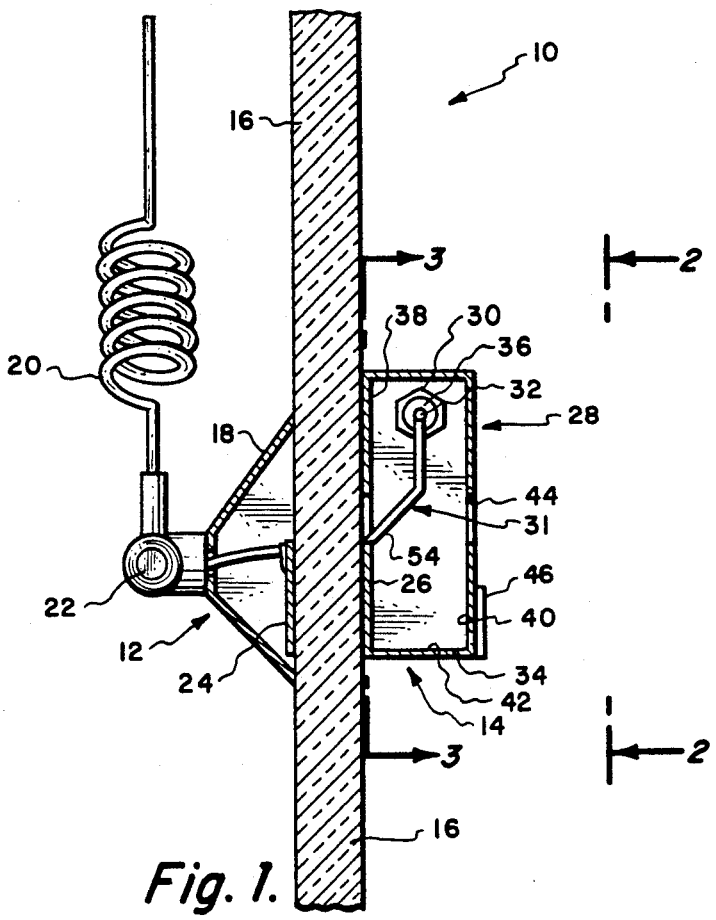
FIG. 1 a side section view of an antenna according to the present invention installed on a glass panel.

With reference first to FIG. 1, there is shown a side section view of a dual mode antenna 10 of the present invention. As seen, the antenna 10 includes an exterior portion 12 and an interior portion 14, shown here separated by a glass plate 16, which can be a window of a vehicle, usually a rear window.

The exterior portion 12 of the antenna 10 includes a base portion 18 to which is mounted a radiator 20 through a swivel 22, permitting an adjustment. A non vertical glass plate 16 will require that the base portion 18 be non vertical. The swivel 22 permits the radiator 20 to be tilted into a vertical, upright position.

The base portion 18 encloses a first coupling plate 24 which is in electrical contact with the radiator 20 through the swivel 22. Mounted opposite the first coupling plate 24, on the other surface of the glass plate 16 is a second coupling plate 26 which is an integral part of a box radiator 28 that includes a BALUN (balanced-unbalanced transformer) which is formed from the structure of the box radiator 28. Radiation in a vertical wave mode is capacitively transmitted between the coupling plates 24, 26 using the glass of the window as a dielectric.

The interior portion 14 includes the box radiator 28 a coaxial connector 30 and a transmission line feed ("TLF") 31. The central conductor 32 of the connector 30 drives the lower half 34 of the box radiator 28 through the TLF 31, while the shielded portion 36 of the connector 30 is connected to the upper half 38 of the box radiator 28. In the preferred embodiment, a conductive plate 40 is bent into a u-shape with the base of the "u" along one side and with the arms of the "u" joined at the bottom by a base plate 42.

A slot 44, which is parallel to the top and bottom edges of the box radiator 28, can be cut into the plate 40 before it is bent. The slot 44 effectively divides the box radiator 28 into lower and upper portions 34, 38. The upper portion provides a fifty (50) ohm impedance for the transceiver so that all energy is efficiently transferred to the radiators.

The base plate 42 effectively short circuits the lower portion 34, resulting essentially in two one quarter wave transmission line connected in parallel to the TLF 31 to form a BALUN transformer. The box radiator 28 is excited by the BALUN in two modes. The vertical polarized mode is transmitted by coupling plates 24, 26 through the glass 16 to the vehicle's external vertical radiator 20.

A pair of horizontally oriented stub antennas 46 are connected to the lower half 34 of the box radiator 28 and extend horizontally therefrom. Any horizontally polarized signals are transmitted and received via the stub antennas 46. A coaxial cable 48 connected to the connector 30 transmits signals between the antenna 10 and a cellular transceiver that is mounted in the interior of the vehicle with which this system is intended to function. Radio frequency signals are carried by the coaxial cable 48 and enable communication between the transceiver and the remote cells of the cellular telephone system.

Figure 2:
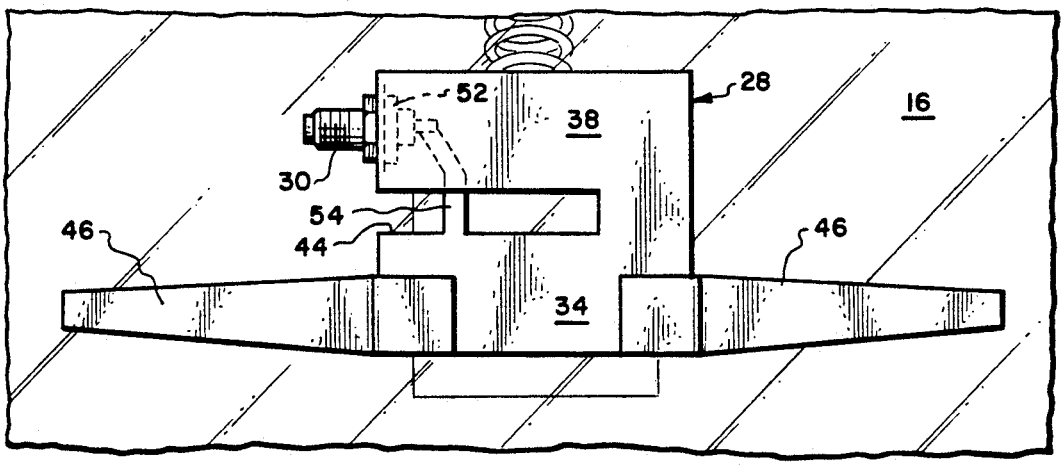
FIG. 2 is a view of the coupling box of FIG. 1, taken along line 2—2 in the direction of the appended arrows.
Figure 3:
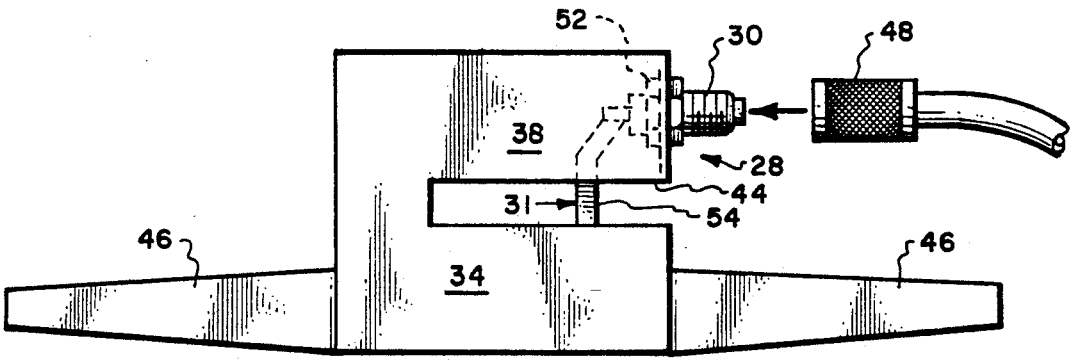
FIG. 3 is a view of the coupling box of FIG. 1, taken along line 3—3 in the direction of the appended arrows.
Figure 4:
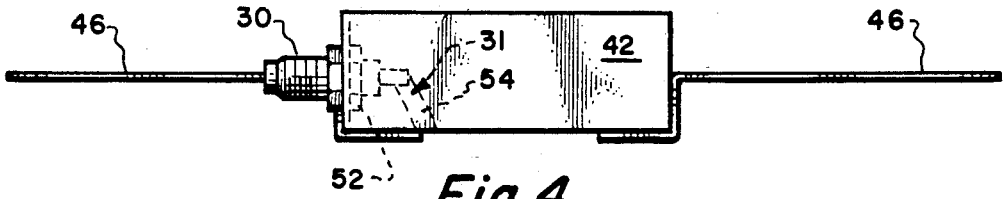
FIG. 4 is a top view of the coupling box of FIG. 1.

The structure of the box radiator 28 can be better understood with reference to FIGS. 2, 3 and 4. FIG. 2 is a view taken along line 2—2 of FIG. 1 in the direction of the appended arrows and is a view of the side which faces the interior of the vehicle. FIG. 3 is a view taken along line 3—3 of FIG. 1 in the direction of the appended arrows and is a view of the side which is adjacent the glass 16 and faces the exterior of the vehicle. FIG. 4 is a top view of the coupling box 28.

In the preferred embodiment, a single sheet of metal 50 is cut and bent to form the box radiator 28. The structure includes a lower u-shaped half 40 which has the TLF 31 installed in the vertical base of the "u". A hexagonal nut 52 fastens the connector 30 to the box radiator 28 and electrically connects the shielded portion of the connector 30 to the upper half 38. The TLF 31 electrically couples the central conductor 32 of the connector 30 to the lower half 34 with a conductive strip 54. This can be seen with reference to FIG. 5.

Figure 5:
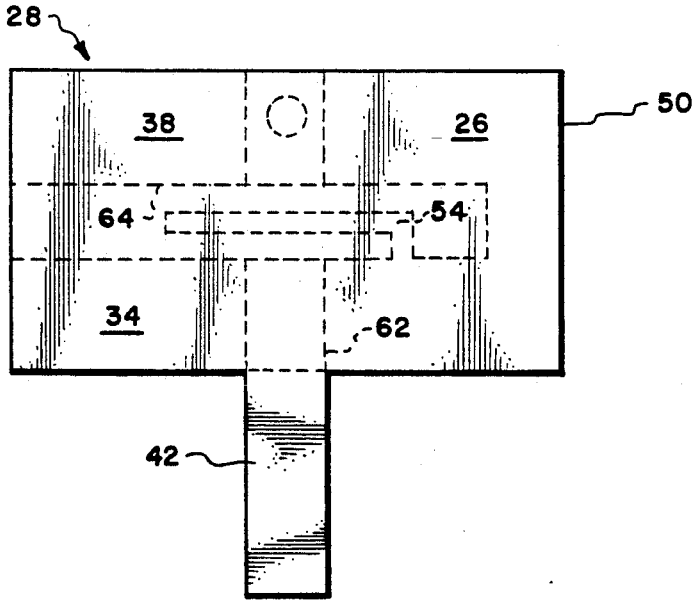
FIG. 5 is a top view of a conductive sheet which can be cut and bent into the coupling box of the antenna combination according to the present invention.

Turning to FIG. 5, the dotted lines 62 represent lines along which the metal should be bent and dashed lines 64 represent lines along which the metal should be cut. If the metal is bent along the dotted lines 62 out of the plane of the drawings, the box 28 will be formed. As can be seen, even the TLF connector strip 54 can be cut and bent from the sheet.

When operating in the transmitting mode, the radio frequency energy from the mobile telephone unit is sent into the coaxial cable and to the connector 30. The high frequency energy divides and excites the lower box portion 34 which transfers the more than half of the energy through the glass to the first coupling plate 24 and into the vertical radiator 20 which has the greater radiating surface. The high frequency energy in the lower box portion 34 is also radiated by the stub antennas 46 which has the lesser radiating surface. The energy radiated from the vertical radiator 20 is vertically polarized and the energy radiated from the stub antennas 46, each of which is approximately a quarter wave, is horizontally polarized.

When operating as a receiver, incoming energy is received on both the vertical radiator 20 and the stub antennas 46. Since the bulk of the received energy is vertically polarized, the first coupling plate 24 transfers this energy to the second coupling plate 26 and excites the lower half 34 of the box 28. At the same time, the horizontal energy component is received by the stub antennas 46, exciting the lower half 34 of the box 28. The received energy is combined and coupled to the upper half 38 of the box 28 and is sent through the coaxial cable to the telephone receiving circuits.

Thus, there has been shown a novel antenna arrangement in which a balanced-unbalanced transformer divides outgoing radio frequency energy into vertically and horizontally polarized components. The same balanced-unbalanced transformer receives both vertically polarized and horizontally polarized components of a signal from a remote transmitter and combines them to enhance overall reception and applies the combined signals to a receiver. By combining the horizontal and vertical components of the received signal, there is less loss of signal through "fading" and "multipath" interference.

It will occur to others skilled in the art to modify the apparatus shown herein to achieve the results of the present invention. Accordingly, the invention should be limited only by the scope of the appended claims.

What is claimed as new is:

1. An antenna assembly for use with a vehicle having an electrically nonconductive area separating the interior from the exterior, the vehicle having a cellular telephone transceiver located therein, the assembly comprising:

a. balanced-unbalanced transformer means mounted on the nonconductive area on the interior of the vehicle, said transformer means having a coaxial connector adapted to be connected to the telephone transceiver through a coaxial cable, and said balanced-unbalanced transformer means further include an excitable box radiator including an excitable slot, said horizontal radiator being connected to one surface of said box radiator on a side adjacent the interior of the vehicle and said vertical radiator being capacitively coupled to a different surface of said box radiator on a side adjacent the exterior of the vehicle;

b. a horizontal radiator connected to said transformer means for transmitting and receiving cellular telephone signals;

c. vertical radiator means mounted on the nonconductive area on the exterior of the vehicle and capacitively coupled to said balanced-unbalanced transformer means for transmitting and receiving cellular telephone signals, whereby in a receiving mode, horizontally polarized received energy is received by means of said horizontal radiator and is combined in said transformer means with vertically polarized energy received by means of said vertical radiator, the combined energy being applied to said coaxial connector for transmission to a transceiver and whereby, in a transmitting mode, energy received from the transceiver through said coaxial connector is divided by said transformer means into a portion which is applied to said vertical radiator and into a portion which is applied to said horizontal radiator.

2. The antenna assembly of claim 1, above wherein said slot subdivides said box radiator into upper and lower portions and wherein said coaxial connector is attached to said upper portion and adapted to connect said upper portion to the shielded side of said coaxial cable and the central conductor of said connector is attached to said lower portion.

* * * * *